US009879502B2

(12) United States Patent
Pedersen

(10) Patent No.: US 9,879,502 B2
(45) Date of Patent: Jan. 30, 2018

(54) BRIDGE PLUG TOOL

(71) Applicant: AKER WELL SERVICE AS, Stavanger (NO)

(72) Inventor: Dag Pedersen, Narvik (NO)

( * ) Notice: Subject to any disclaimer, the term of this patent is extended or adjusted under 35 U.S.C. 154(b) by 569 days.

(21) Appl. No.: 14/397,802

(22) PCT Filed: Apr. 30, 2013

(86) PCT No.: PCT/EP2013/058998
§ 371 (c)(1),
(2) Date: Oct. 29, 2014

(87) PCT Pub. No.: WO2013/164343
PCT Pub. Date: Nov. 7, 2013

(65) Prior Publication Data

US 2015/0122511 A1 May 7, 2015

(30) Foreign Application Priority Data

Apr. 30, 2012 (GB) ..... 1207467.0

(51) Int. Cl.
*E21B 33/134* (2006.01)
*E21B 23/00* (2006.01)
(Continued)

(52) U.S. Cl.
CPC ..... *E21B 33/134* (2013.01); *E21B 23/00* (2013.01); *E21B 23/06* (2013.01); *E21B 31/00* (2013.01); *E21B 33/1293* (2013.01)

(58) Field of Classification Search
CPC ..... E21B 33/134; E21B 23/01; E21B 23/06; E21B 31/107
See application file for complete search history.

(56) References Cited

U.S. PATENT DOCUMENTS 4,359,090 A * 11/1982 Luke ..... E21B 33/1293 166/118
4,436,150 A * 3/1984 Barker ..... E21B 23/065 166/123
2011/0277989 A1* 11/2011 Frazier ..... E21B 33/129 166/193

FOREIGN PATENT DOCUMENTS

GB 1398038 6/1975
WO WO 92/17681 10/1992
WO WO 2012/140201 A2 10/2012

OTHER PUBLICATIONS

International Patent Application No. PCT/EP2013/058998: International Search Report and Written Opinion, dated Jul. 30, 2014 (11 pages).

* cited by examiner

*Primary Examiner* — Giovanna C. Wright
*Assistant Examiner* — Tara E Schimpf
(74) *Attorney, Agent, or Firm* — Finnegan, Henderson, Farabow, Garrett & Dunner LLP.

(57) ABSTRACT

A bridge plug tool for use in a well, comprising: a tool body (70); a hollow mandrel (26) extending through the tool body, the mandrel having a removable plug (32) in an upper region (37) to prevent from of fluids through the mandrel, the plug comprising a plug locking member (40) that is axially movable between a first position in which it locks the plug inside the mandrel and a second position in which the plug is released from the mandrel and can be removed; a setting sleeve (16) positioned on the tool body; a packer module (18) located below the setting sleeve; an anchor module (20) located blow the packer module; and an end fitting located below the anchor module; wherein the mandrel extends through the sleeve, packer module and anchor module to the end fitting; and wherein the end fitting comprises a first part
(Continued)

that is configured for engagement with the mandrel, and a second part that is releasably connected to the first part and moveable between a connected position in which the second part holds the first part in engagement with the mandrel such that the end fitting is secured to the mandrel, and a disconnected position in which second part moves relative to the first part so that the first part is free to disengage from the mandrel, such that when the mandrel is secured to the end fitting, the packer module and anchor module can be held in compression between the setting sleeve and the end fitting, and when the mandrel is released from the end fitting, any such compression is released.

14 Claims, 4 Drawing Sheets

(51) Int. Cl.

| | |
|---|---|
| ***E21B 33/129*** | (2006.01) |
| ***E21B 23/06*** | (2006.01) |
| ***E21B 31/00*** | (2006.01) |

BRIDGE PLUG TOOL

CROSS-REFERENCE TO RELATED APPLICATIONS

This application is a national phase application of international Application No. PCT/EP2013/058998, filed Apr. 30, 2013, and claims the priority of Great Britain Application No. 1207467.0, filed Apr. 30, 2012, the content of all of which is incorporated herein by reference.

FIELD OF THE INVENTION

This invention relates to bridge plug tools and to methods of operating bridge plug tools. Such tools and methods find use in oil and gas wells or the like.

BACKGROUND

WO2012/140201 (incorporated herein by reference) describes a bridge plug tool of the general type to which this invention applies. Releasing such tools from position in a well typically comprises two operations: equalization, in which the fluid pressure in the well above and below the tool is equalized, and release in which the setting force applied to expand anchor and packer members is released, allowing the anchors and packer to contract to release the tool from the well.

The tool described in WO2012/140201 comprises two mechanisms for each operation. The primary equalization and release mechanisms are provided for normal use in which the operations are carried out under optimal control and the tool is easily reset for further use by returning parts of the tool to initial positions and replacement of shear screws, seals, etc. The secondary equalization and release mechanisms are provided in case the primary mechanisms fail and the tool would otherwise remain stuck in the well. However, operation of the secondary mechanisms is more severe and requires significant reconditioning of the tool before it can be used again.

One or both of the secondary equalization and release mechanisms described in WO2012/140201 requires application of torque and a rotary, unscrewing, motion. Such force can be difficult to apply downhole.

This invention aims, inter alia, to provide secondary equalization and release mechanisms that can be operated using axial (push or pull) forces, that can be easily generated downhole

SUMMARY

One aspect of this invention comprises a bridge plug tool for use in a well, comprising: a tool body; a hollow mandrel extending through the tool body, the mandrel having a removable plug in an upper region to prevent from of fluids through the mandrel, the plug comprising a plug locking member that is axially movable between a first position in which it locks the plug inside the mandrel and a second position in which the plug is released from the mandrel and can be removed; a setting sleeve positioned on the tool body; a packer module located below the setting sleeve; an anchor module located blow the packer module; and an end fitting located below the anchor module; wherein the mandrel extends through the sleeve, packer module and anchor module to the end fitting; and wherein the end fitting comprises a first part that is configured for engagement with the mandrel, and a second part that is releasably connected to the first part and moveable between a connected position in which the second part holds the first part in engagement with the mandrel such that the end fitting is secured to the mandrel, and a disconnected position in which second part moves relative to the first part so that the first part is free to disengage from the mandrel, such that when the mandrel is secured to the end fitting, the packer module and anchor module can be held in compression between the setting sleeve and the end fitting, and when the mandrel is released from the end fitting, any such compression is released.

A second aspect of the invention provides a method of operating a tool as claimed in any preceding claim, wherein the tool has been locked in position in a well by compression of the packer module and anchor module between the setting sleeve and the end fitting, the method comprising: application of an axial force to the plug locking member to move it from its first position to its second position; removing the plug from the mandrel so as to allow fluid communication through the mandrel to equalize fluid pressure in the well above and below the tool; application of an axial force to the second part of the end fitting to move it from its connected position to its disconnected position so as to release the end fitting from the mandrel and so release compressive forces on the packer module and anchor module; and removing the tool from the position in the well.

Further aspects of the invention are set forth in the claims and will be apparent from the following description.

DETAILED DESCRIPTION

Figure 1:
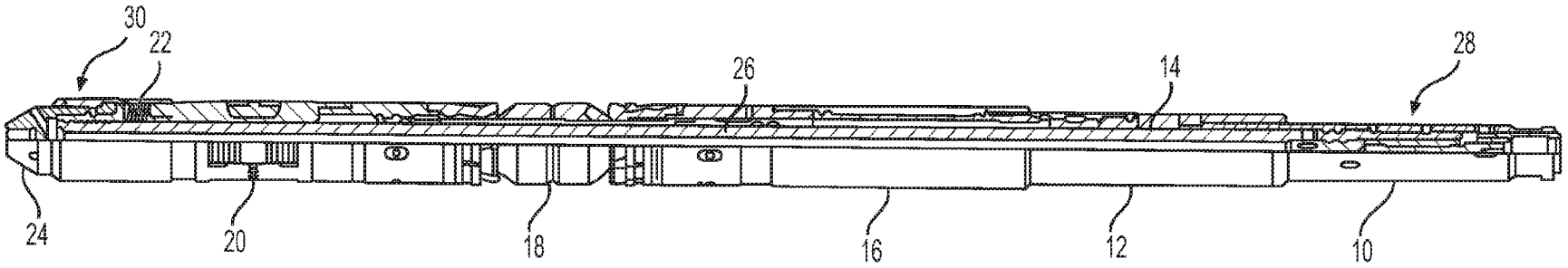
FIG. 1 shows a part sectioned view tool according to one embodiment of the invention.

FIG. 1 shows a general view of the tool of an embodiment of the invention, comprising a fishing neck 10, a release sleeve 12, a ratchet tube 14, a setting sleeve 16, a packer module 18, and anchor module, 20, springs 22 and a bullnose 24. A hollow mandrel 26 extends through the middle of the tool. The construction and operation of the setting and primary equalization and release mechanisms is substantially as describe in paragraphs [0028] and [0032] of WO2012/140201.

The tool shown in the drawings differs from that described in WO2012/140201 in respect of the secondary equalization mechanism 28 and the secondary release mechanism 30.

Figure 2:
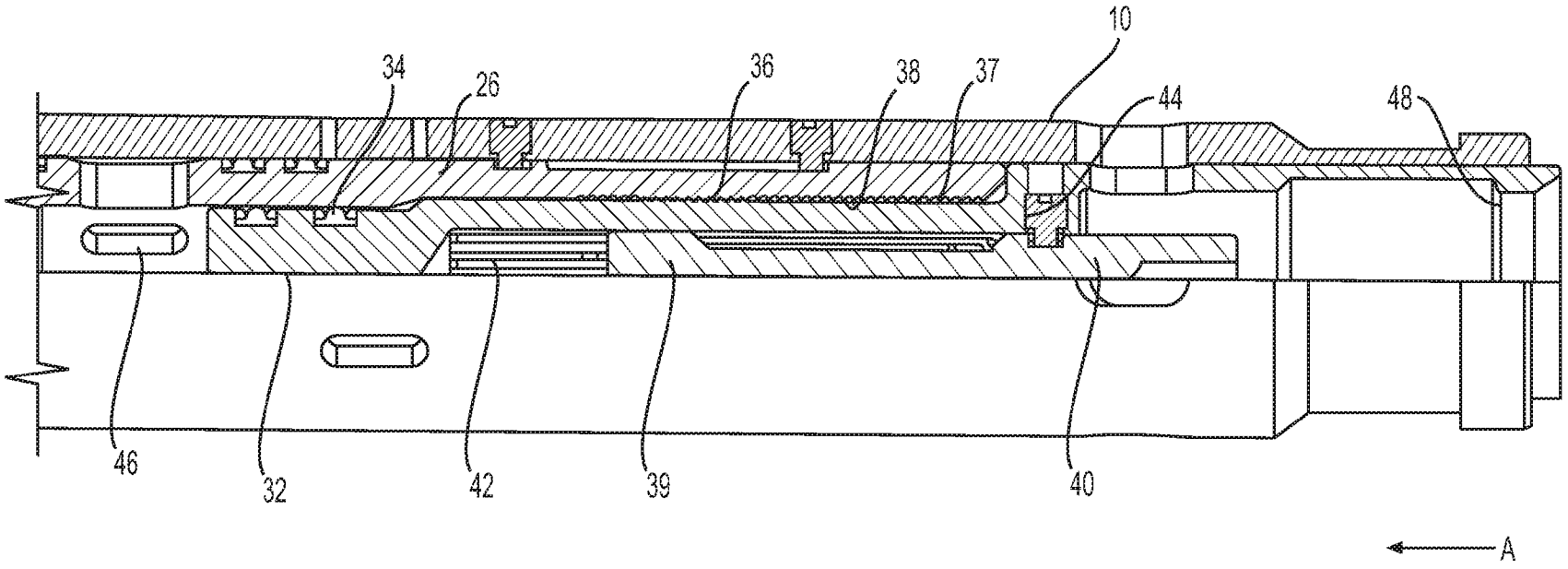
FIG. 2 shows a detailed view of the secondary equalization mechanism of the tool of FIG. 1.
Figure 3:
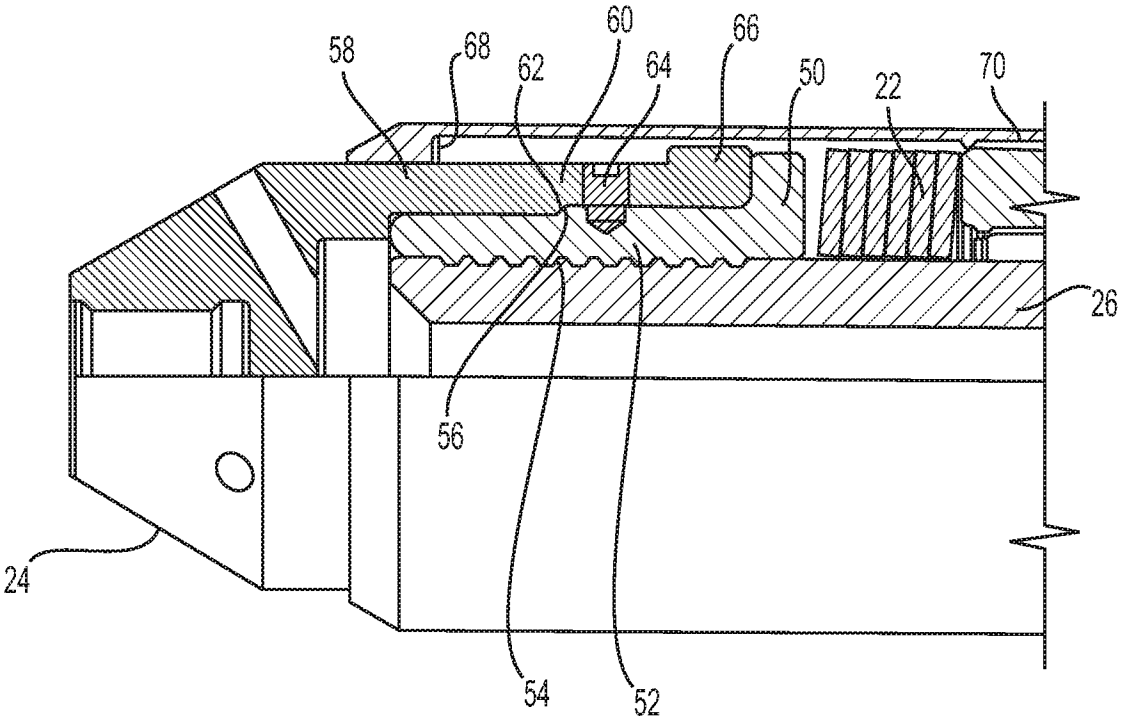
FIG. 3 shows a detailed view of the secondary release mechanism of the tool of FIG. 1.

The secondary equalization mechanism is shown in more detail in FIG. 2. The top part of the mandrel 26 is closed by a plug 32 which seals against an inner surface 34 of the mandrel 26 and is held in place by inter-engagement of ratchet formations 36 on the inner surface of the mandrel 26 and ratchet formations 38 on the outer surface of the upper part 37 of the plug 32. The upper part of the plug 37 has slots 42 that allow the ratchet formations 38 to flex radially. Disengagement of the ratchet formations 36, 38 is prevented by an end portion 39 of a plug locking member 40 which engages inside the upper part 37 of the plug 32 and prevents flexing of the formations 38 so as to hold the ratchet formations 38 of the plug 32 against the ratchet formations 36 of the mandrel 26. The plug locking member 40 is held in place by a shear screw 44.

In primary equalization, ports 46 in the mandrel 26 below the plug 32 would be opened in the same manner as is described for primary equalization in WO2012/140201.

If operation of the primary equalization mechanism is not possible, secondary equalization can be achieved by removing the plug 32 completely from the mandrel 26. In order to release the plug, the plug locking member 40 is tapped/jarred down (direction A) by means of a prong on a fishing tool (not shown). This has the effect of shearing the screw 44 and pushing the plug locking member 40 down inside the plug 32 so that the end portion 39 is moved away from the ratchet formations 38. The ratchet formations 38 are now free to flex radially inwards and disengage from the ratchet formations 36 in the mandrel. At this point, the plug 32 can be withdrawn from the mandrel 26 by means of the fishing tool which can be engaged in the plug fishing neck 48. Well fluid can then flow through the mandrel, equalizing pressure above and below the tool.

In primary release, the release sleeve 12 is pulled up, releasing locking dogs from the mandrel 26 and allowing the mandrel 26 to move down relative to the setting sleeve 16 and release the compression on the packer and anchor modules 18, 20 in the same manner as is described for primary equalization in WO2012/140201.

If operation of the primary release mechanism is not possible, secondary release can be achieved by disconnecting the bullnose 24 completely from the mandrel 26.

The bullnose 24 forms part of a two-part end fitting for the tool that is normally secured to the mandrel 26. By contracting the setting sleeve 16 towards the bullnose 24, the packer and anchor modules 18, 20 can be compressed. The spring 22 ensures that the various parts of the tool are in compression during all normal stages of operation of the tool. The end fitting comprises, as a first part, an axially-divided ring nut 50 (in this example, three equal sectors are provided but other numbers and configurations can be used) which is positioned around the outside of the end of the mandrel 26. Threads 52 on the inside of the nut 50 are engaged on corresponding threads 54 on the outside of the end of the mandrel 26. The outer surface of the nut 50 has a step formation 56. The bullnose 24 provides the second part of the end fitting. The upper part 58 of the bullnose 24 defines a ring 60 which has a step formation 62 corresponding to that of the nut 50. In a first, connected position, the ring 60 surrounds the nut 50 such that the step formations 56, 62 are engaged. The nut 50 and bullnose 24 are held together by a shear screw 64. In the connected position, the threads 52 of the nut 50 are held in engagement with the threads 54 on the mandrel 26, thus securing the end fitting to the mandrel.

Figure 4:
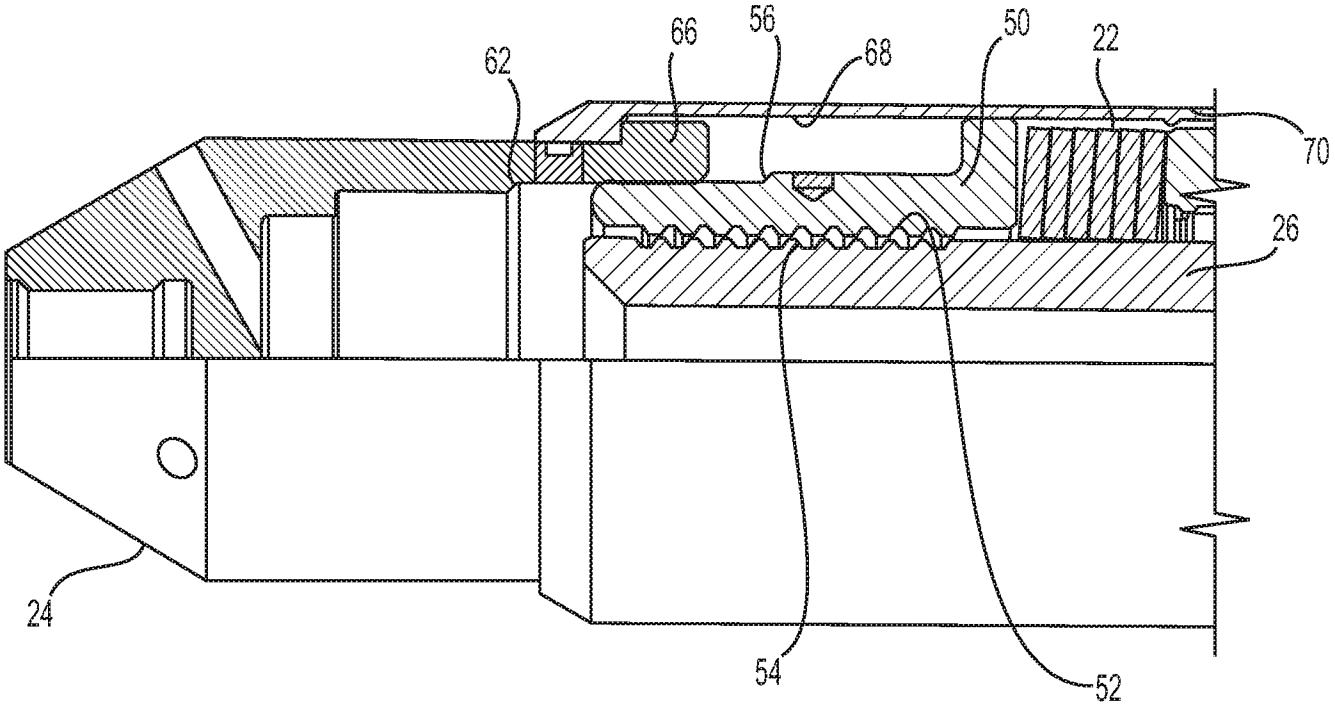
FIG. 4 shows the secondary release mechanism of FIG. 3 in a released configuration.

Secondary release can be achieved by tapping/jarring down (direction A) on the bullnose 24 using a prong on a tool (not shown) that extends through the inside of the mandrel 26. This has the effect of shearing the screw 64 so that the bullnose 24 is no longer connected to the nut 50 and can drop or be pushed down, separating the step formations 56, 62. At this point, the sectors of the nut are free to move outwardly so that the threads 52, 54 disengage and the end fitting is released from the mandrel. Downward movement of the bullnose 24 is limited by projections 66 projecting outwardly from the end upper part 58 of the bullnose 24 into slots 68 in the tool body 70, thus preventing complete detachment of the bullnose 24 from the tool. FIG. 4 shows the end fitting released from the mandrel.

When the bullnose 24 has dropped, compression on the packer and anchor modules is released, causing the packer and anchors to contract and allowing the tool to be moved.

Both the secondary equalization and secondary release mechanisms described above rely only on axial forces for operation. Furthermore, the axial forces necessary to achieve operation of the secondary mechanisms are applied in the same direction as is used for operation of the primary mechanisms and normally act to release the tool from the well. Therefore, operation of the secondary mechanisms does not exacerbate problems by reinforcing setting forces.

It will also be appreciated that the secondary equalization mechanism and secondary release mechanism are not interdependent. It would therefore be possible to use the secondary equalization mechanism with another secondary release mechanism, and vice versa.

Further changes can be made within the scope of the invention.

The invention claimed is:

1. A bridge plug tool for use in a well, comprising:
a tool body;
a hollow mandrel extending through the tool body, the mandrel having a removable plug in an upper region to prevent flow of fluids through the mandrel, the plug comprising a plug locking member that is axially movable between a first position in which it locks the plug inside the mandrel and a second position in which the plug is released from the mandrel and can be removed;
a setting sleeve positioned on the tool body;
a packer module located below the setting sleeve; and
an anchor module located below the packer module; and
an end fitting located below the anchor module;
wherein the mandrel extends through the sleeve, packer module and anchor module to the end fitting;
wherein the end fitting comprises a first part that is configured for engagement with the mandrel, and a second part that is releasably connected to the first part and moveable between a connected position in which the second part holds the first part in engagement with the mandrel such that the end fitting is secured to the mandrel, and a disconnected position in which second part moves relative to the first part so that the first part is free to disengage from the mandrel, such that when the mandrel is secured to the end fitting, the packer module and anchor module can be held in compression between the setting sleeve and the end fitting, and when the mandrel is released from the end fitting, any such compression is released;
wherein the second part of the end fitting comprises projections which extend into slots in the tool body so as to limit the range of movement of the end fitting relative to the tool body when disconnected from the mandrel.

2. A tool as claimed in claim 1, wherein the mandrel has formations on its inner surface and the plug has formations on its outer surface, the plug locking member acting to hold the formations in mutual engagement only when in the first position.

3. A tool as claimed in claim 2, wherein the formations are ratchet formations.

4. A tool as claimed in claim 1, wherein the plug locking member is held in the first position by means of a frangible locating device.

5. A tool as claimed in claim 1, wherein primary equalization ports are provided in the mandrel below the plug.

6. A tool as claimed in claim 1, wherein the mandrel is configured such that removal of the plug allows free access through the inside of the mandrel along substantially its whole length.

7. A tool as claimed in claim 1, wherein the mandrel has formations on its outer surface and the first part of the end fitting has formations on its inner surface, the second part of the end fitting acting to hold the formations in mutual engagement only when in the connected position.

8. A tool as claimed in claim 7, wherein the formations are ratchet formations.

9. A tool as claimed in claim 1, wherein the first and second parts of the end fitting are held in the connected position by means of a frangible locating device.

10. A method of operating a tool as claimed in claim 1, wherein the tool has been locked in position in a well by compression of the packer module and anchor module between the setting sleeve and the end fitting, the method comprising:

applying of an axial force to the plug locking member to move it from its first position to its second position;

removing the plug from the mandrel so as to allow fluid communication through the mandrel to equalize fluid pressure in the well above and below the tool;

applying of the axial force to the second part of the end fitting to move it from its connected position to its disconnected position so as to release the end fitting from the mandrel and so release compressive forces on the packer module and anchor module; and removing the tool from the position in the well.

11. A method as claimed in claim 10, wherein the mandrel and plug have inter-engaging formations on respective inner and outer surfaces, movement of the plug locking member into the second position allowing disengagement of the formations.

12. A method as claimed in claim 10, wherein application of the axial force ruptures a frangible locating device holding the plug locking member in the first position.

13. A method as claimed in claim 10, wherein the mandrel and the first part of the end fitting have inter-engaging formations on respective outer and inner surfaces, movement of the second part of the end fitting into the disconnected position allowing disengagement of the formations.

14. A method as claimed in claim 10, wherein application of the axial force ruptures a frangible locating device holding the first and second parts of the end fitting in the connected position.

* * * * *